US008162784B1

(12) United States Patent
Bellefeuille

(10) Patent No.: US 8,162,784 B1
(45) Date of Patent: Apr. 24, 2012

(54) SURVIVAL TOOL AND SYSTEM

(76) Inventor: Philip E. Bellefeuille, Fresno, CA (US)

( * ) Notice: Subject to any disclaimer, the term of this patent is extended or adjusted under 35 U.S.C. 154(b) by 79 days.

(21) Appl. No.: 12/802,544

(22) Filed: Jun. 9, 2010

Related U.S. Application Data

(60) Provisional application No. 61/268,358, filed on Jun. 11, 2009.

(51) Int. Cl.
*F42B 6/08* (2006.01)
*F41B 3/02* (2006.01)

(52) U.S. Cl. ..... 473/583; 30/346; 30/349; 124/20.3

(58) Field of Classification Search ..... 30/346, 30/349; 124/20.1, 20.2, 20.3; 473/578, 582, 473/583
See application file for complete search history.

(56) References Cited

U.S. PATENT DOCUMENTS

| | | | | |
|---|---|---|---|---|
| 102,677 | A | | 5/1870 | Gregory |
| 302,097 | A | | 7/1884 | Call |
| 810,987 | A | | 1/1906 | Spicer |
| 872,271 | A | | 11/1907 | Benet |
| 2,105,239 | A | | 1/1938 | Bachtold |
| 2,377,730 | A | | 6/1945 | Vosbikian et al. |
| 3,387,698 | A | | 6/1968 | Hendricks et al. |
| 3,448,518 | A | * | 6/1969 | Sklar ..... 30/162 |
| 3,760,438 | A | | 9/1973 | White |
| 4,002,236 | A | | 1/1977 | Tolleson |
| 4,167,810 | A | * | 9/1979 | Gilbert ..... 30/2 |
| 4,209,900 | A | * | 7/1980 | Gilbert ..... 30/162 |
| 4,727,609 | A | | 3/1988 | Smith, Jr. |
| 5,421,460 | A | | 6/1995 | Bosshard |
| 5,706,583 | A | * | 1/1998 | Gengenbach ..... 30/166.3 |
| 6,938,345 | B2 | * | 9/2005 | Yu ..... 30/123 |
| 7,410,434 | B2 | | 8/2008 | Perkins, Sr. |
| 7,448,136 | B2 | | 11/2008 | Huang |

* cited by examiner

*Primary Examiner* — John Ricci

(57) ABSTRACT

A survival tool and system for use in hunting or camping may be provided in a compact and easy to carry package. The tool system may include a substantially rigid base with an outer edge and a substantially flat face. A relief may be provided in the substantially rigid base defining one or more edged tools in the substantially flat face. Applying pressure to the edged tool may cause the tool to separate from the substantially rigid base. The edged tools may be in the shape of an arrowhead or other utility element. One or more secondary tools may be incorporated into the outer edge, including a knife blade, a saw blade, an arrow scraper, a flat scraper and a bow rail. An elastic element may be fastened to the base and used to launch a projectile such as an arrow. One or more bases may be sized to fit in a common sized "tin" or similar in size to a dog tag and may be carried around the neck of a user. A sheath may also be provided to cover one or more of the outer edges.

23 Claims, 7 Drawing Sheets

SURVIVAL TOOL AND SYSTEM

CROSS-REFERENCE TO RELATED APPLICATION DATA

Priority is claimed under 35 U.S.C. §119(e) to U.S. Provisional Application No. 61/268,358, filed on Jun. 11, 2009, which is incorporated by reference herein.

FIELD OF THE INVENTION

The present invention generally relates to multi-function tools and, more particularly, to tools used in hunting and in survival conditions.

BACKGROUND OF THE INVENTION

Mankind has a primitive instinct to survive. In the case of a hiker getting lost in the wilderness, a vehicle breaking down in a remote area, or a natural disaster, the difference between life and death may depend on the resourcefulness, training and tools of the individual. The most basic needs are security, food, shelter and water. In the absence of any immediate medical needs, these are the most basic elements of survival. Plant life is typically not very rich in nutrients as compared to meat. Therefore, hunting for wild game may be desired, as one kill may provide much needed protein and calories and the skin may be used for protection against the elements.

Hunting may be difficult without any weapons or ammunition. Many parks do not allow hikers to carry firearms and most people that own guns may not think to bring them along on a simple hiking trip or a drive across a mountain pass. When things go bad, may times it takes even the most prepared traveler off guard. If a small and lightweight kit could be stored in a first-aid kit or the backpack of a hiker, the tools of the kit could be available without the conscious thought required to bring a more traditional weapon and ammunition.

It should, therefore, be appreciated that there is a need for a compact survival tool system that could easily fit in a backpack or glove compartment of a vehicle. The present invention fulfills this need and others.

SUMMARY OF THE INVENTION

The present invention provides a survival tool system including a substantially rigid base which may include an outer edge and a substantially flat face. The base may also include a relief defining an edged tool in the substantially flat face, whereby applying pressure to the edged tool may cause the tool to separate from the substantially rigid base. The substantially rigid base may also include a secondary tool incorporated into the outer edge. The secondary tool may include elements such as a knife blade with a beveled edge; a saw blade; and an arrow scraper, with an arcuate scraping edge adapted to receive an arrow shaft. The secondary tool may also include a flat scraper with a substantially flat edge; or a bow rail including a "U-shaped" opening.

The substantially rigid base may have the general shape of a parallelogram which may include one dimension between 3.30 and 3.55 inches and a second dimension between 2.0 and 2.25 inches. The substantially flat face may include a hole with a tether received by the hole, whereby the tether may be used to secure transport of the survival system or to secure the base to the hand of a user. A sheath may be provided and received by at least one outer edge of the substantially rigid base.

The edged tool may be in the shape of an arrowhead of varying shapes and sizes. The edged tool may include a blade portion and a shank portion and the blade portion may include a beveled edge on one or both sides. The relief may define more than one edged tool in the substantially flat face.

The tool system may include an elastic element which may be fastened to the substantially rigid base. The elastic element may be adapted to receive a projectile. The system may further include a projectile support to aid in support of the projectile while in contact with the elastic element. This projectile support may be in the form of a ledgecard or a cross cord fastened to the substantially rigid face. The cross cord may be comprised of one or more individual cords.

An exemplary method for producing a defense weapon for use with a survival system of the type including a substantially rigid base with an outer edge and a substantially flat face; and a relief defining an edged tool in the substantially flat face. The method may include producing a weapon including the steps of applying pressure to the edged tool; separating the tool from the substantially rigid base; and fastening the tool to one end of an elongate stick.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment (s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
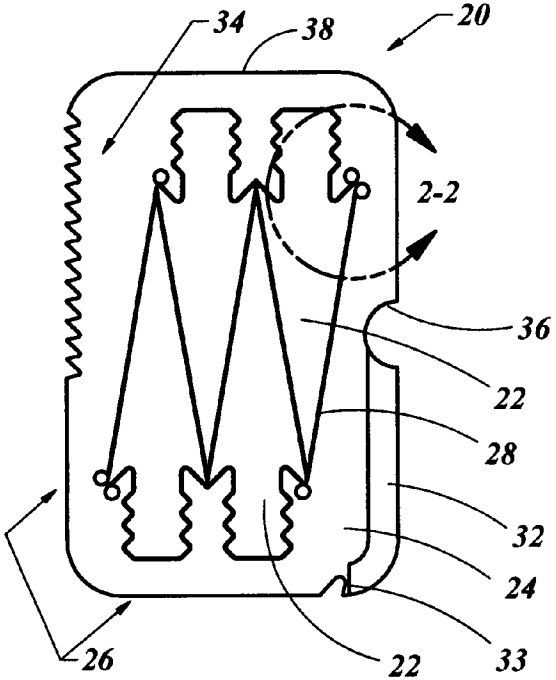
FIG. 1 is a plan view of a survival tool base produced in accordance with the present invention.
Figure 2:
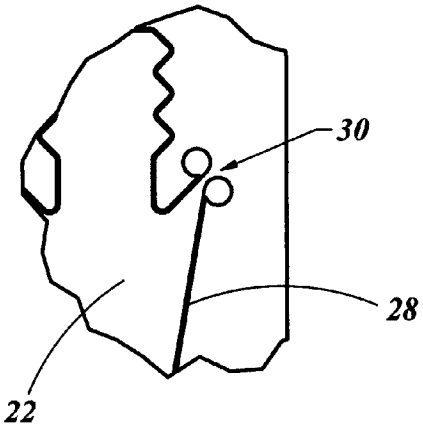
FIG. 2 is a detail view of the tip of the tool base of FIG. 1 shown along line 2-2.

With reference to the illustrative drawings, and particularly to FIGS. 1 and 2, there is shown a survival tool base 20. The tool base 20 may include one or more edged tools 22, which may be in the form of an arrowhead. The tool base 20 includes a substantially flat face 24 and an outer edge 26 extending around the outer dimensions of the tool base 20.

The edged tools 22 may be separated from the tool base 20 by a relief 28 that encompasses all but a small portion of the perimeter of each edged tool 22. A support contact 30 is shown in detail in FIG. 2, which provides structural support to keep a portion of the edged tool 22 in substantially the same plane of the flat face 24 of the tool base 20. The support contact 30 may be a gap in the relief 28 that is large enough to maintain the generally coplanar orientation of the edged tools 22 and the flat face 24. This enables the tool base 20 to be in the form of a "card" where the structure of the card acts as a sheath to the potentially sharp edges of the edged tools 22. This enables the edged tools 22 to be stored and carried in a convenient, lightweight and portable utility package when not in use and easily removed from the rest of the tool base 20 when desired and without any special tools.

Figure 3:
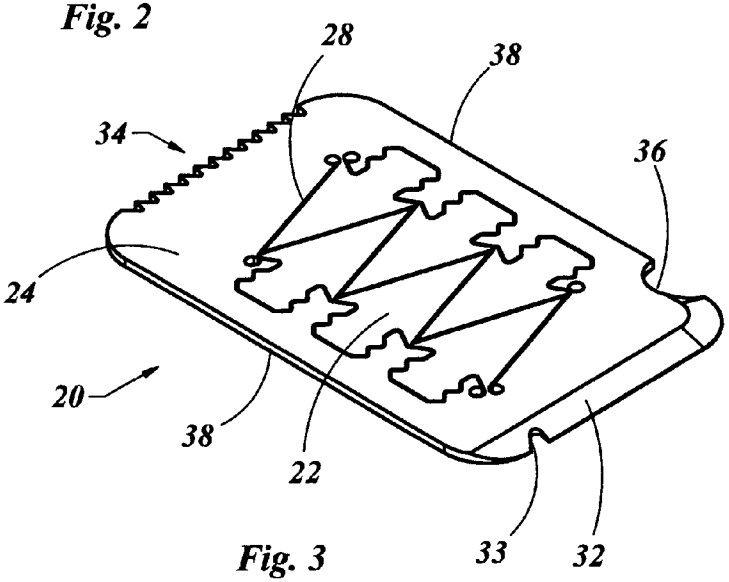
FIG. 3 is an isometric view of an alternative form of the survival tool base of FIG. 1.
Figure 4:
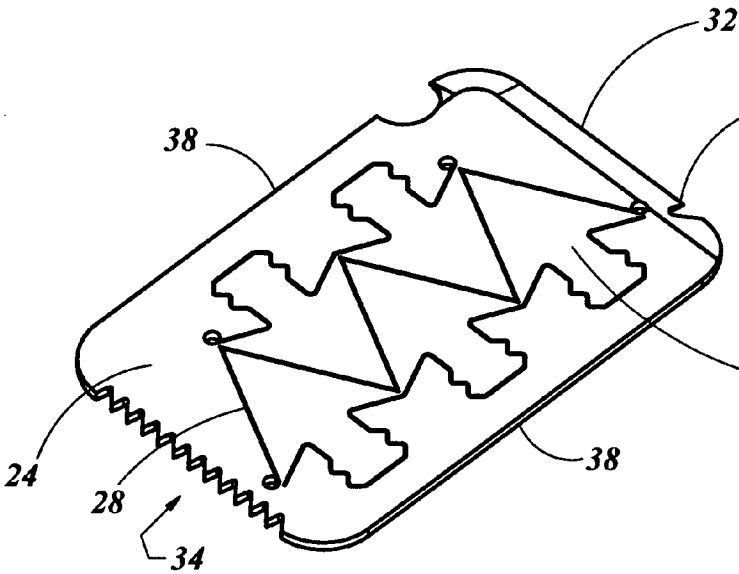
FIG. 4 is an isometric view of a second alternative form of the survival tool base of FIG. 1.

The tool base 20 may include any number of utility options, as secondary tools, incorporated into the outer edge 26 of the tool base 20. Some examples are shown in FIG. 1 as well as FIGS. 3 through 5. Though different orientations and configurations are shown, the utility of each tool base 20 may be similar. It is understood that an infinite number of design modifications are inherently included as variations of the embodiments disclosed. A knife edge 32 including a beveled edge may be provided to cut or slice. A serration or notch 33 may be included in the knife blade 32. A saw blade 34 may be provided to saw branches or other wood items to make a shelter, or an arrow shaft, to name a few of the many possibilities.

In that the edged tools 22 may be used as arrowheads, it is highly plausible that the need may arise to make an arrow shaft. To aid in this process an arrow scraper 36 may be provided. The arrow scraper 36 may include an arcuate scraping edge adapted to receive an arrow shaft. This arcuate edge may be a useful tool in shaping a piece of wood into a smooth longitudinal shaft, suitable to hold the arrowhead, and therefore be made into a projectile to be used as a formidable hunting tool. To remove bark or rough debris, a flat scraper 38 with a substantially flat edge may be provided.

Though variations in the shape and orientation of the edged tools 22 are shown in the figures as noted, the general function may be similar. In each case the edged tool 22 is in the shape of an arrowhead of different shapes or configurations. These variations as shown here are not meant to me limiting to the scope of the invention, but are presented as examples of the versatility of the invention. Different edged tools 22 such as blades for wood working, including tools to plane and shape wood, or chisel rock may also be provided, alone or in combination with the hunting and defense tools shown here. Each may have a benefit in providing food, protection from predators or shelter from the elements, aiding the survival of the user.

Figure 5:
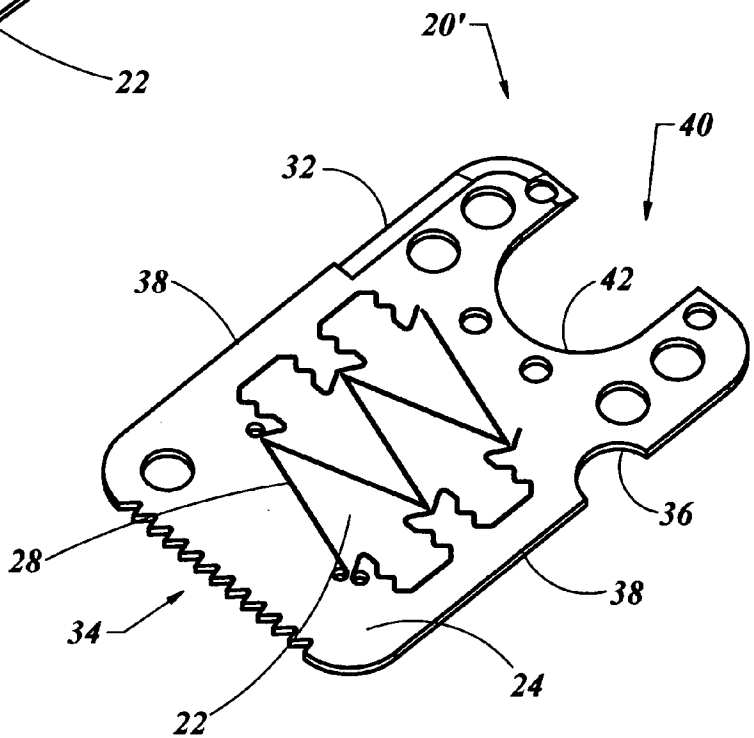
FIG. 5 is an isometric view of a third alternative form of the survival tool base of FIG. 1, in this form the base including a bow rail

With specific reference to FIG. 5, a modification is provided to enable a unique feature of the base tool 20'. Here a secondary tool has been added which is comprised of a bow rail 40 and includes a U-shaped opening 42. The U-shaped opening 42 of the bow rail 40 allows for passage of an arrow or other projectile when an elastic element is anchored to the base tool 20'. This will be presented in greater detail further in the disclosure.

The size of the base tool 20 may vary. In the preferred embodiment the shape of the base tools 20 may be substantially the shape of a parallelogram, with one side having a dimension between 3.30 and 3.55 inches and a second dimension between 2.0 and 2.25 inches. This size allows the base tools 20 to be stored in a common "tin" such as an Altoids® can. Other embodiments may be larger or smaller. A smaller embodiment is the size of a dog tag, approximately 1.12 inches by 2.0 inches. In this embodiment a single edge tool 22 may be used as well as one or more of the secondary tools on the outer edges. This embodiment may allow for effortless transport of the base tool 20 around the neck of the user.

Figure 7:
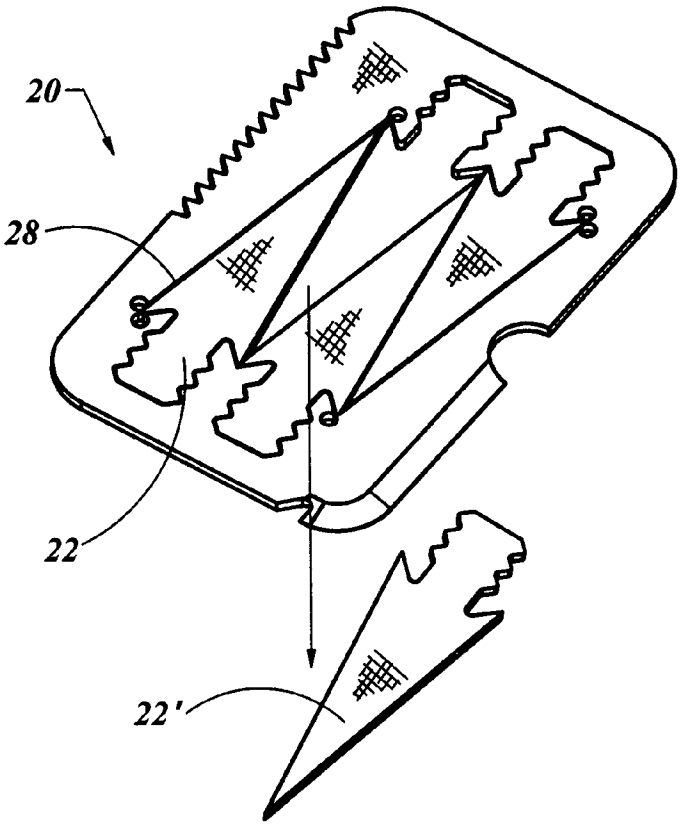
FIG. 7 is an isometric view of the survival tool base of FIG. 6, with the arrowhead fully displaced from the tool base.
Figure 6:
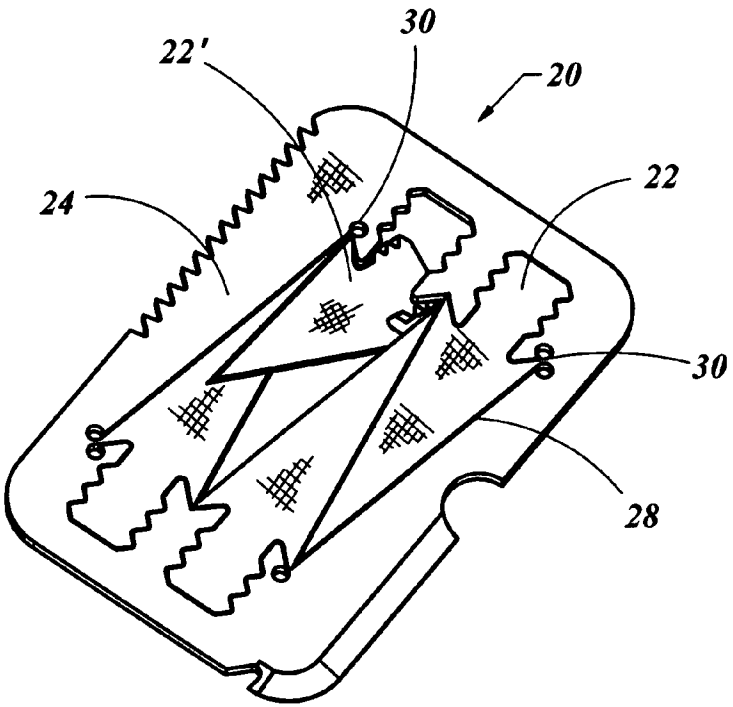
FIG. 6 is an isometric view of the survival tool base as shown in FIG. 1 with one of the edged tools in the form of an arrowhead, being displaced from the tool base.

With reference to FIGS. 6 and 7, the edged tools 22 may be removed from the base tool 20 by applying pressure to one of the edged tools 22' relative to the flat face 24, causing the desired edged tool 22' to be displaced from the coplanar orientation with the flat face 24. The structural integrity of the support contact 30 is compromised without necessarily causing any significant deformation to the desired edge tool 22'. The desired edge tool 22' may be "worked" by twisting and rotating the edged tool 22' relative to the rest of the base tool 20, until the selected edged tool 22' is free from the remainder of the base tool 20.

Depending on the design and manufacturing process and material used, the support contact 30 may be weak enough to allow a user of average finger strength to apply enough force to remove the desired edge tool 22' and yet strong enough to minimize the potential for the any edged tool 22 to be inadvertently removed. Unintentional removal of an edged tool 22 may cause injury to the user or become lost and therefore not available when needed by the user. The scope of the invention also accounts for the addition of a supplemental tool to aid in the removal of the edged tools 22 from the base tool 20. This would allow for greater integrity of the support contact 30, thereby reducing the likelihood of accidental removal of the edged tool 22.

Figure 8:
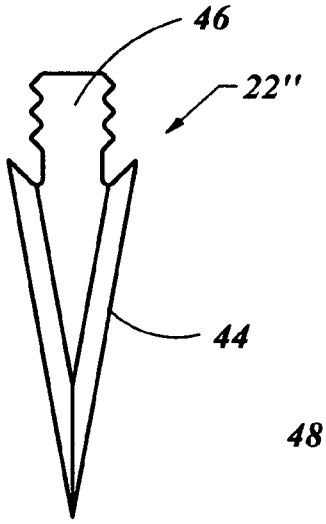
FIG. 8 is a plan view of an edged tool in the form of an arrowhead.
Figure 9:
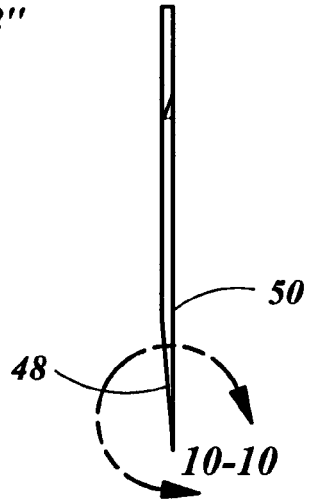
FIG. 9 is a side view of the edged tool of FIG. 8 showing a single bevel.
Figure 10:
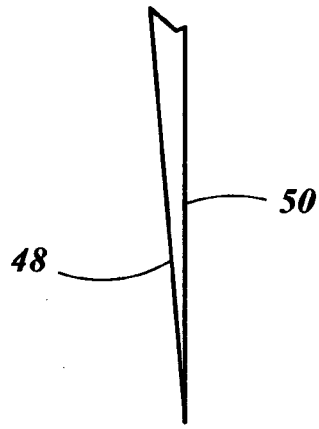
FIG. 10 is a detail view of the tip of the edged tool of FIG. 9 shown along line 10-10.

With reference to FIGS. 8 through 13, two versions of the edged tools 22 are illustrated. In FIG. 8, a plan view of an edge tool 22" with a single bevel is shown. In this embodiment of the invention, the edge tool 22" is shown as an arrowhead, which may include a blade portion 44 and a shank portion 46. The shank portion 46 may be adapted to be received by one end of an elongate rod to be used as an arrow shaft. This will be further described and shown further in the disclosure. The blade portion 44 may include a single beveled edge 48, as is shown in FIG. 9 and in more detail in FIG. 10. The back side 50, as shown here, may have no bevel. To achieve such a cutting edge as provided by the single beveled edge 48 may be achieved by a milling, grinding, stamping, or any other process known in the art, on this edge before, after or during the process of cutting the relief 28 to give the edged tools 22 their shape.

Figure 11:
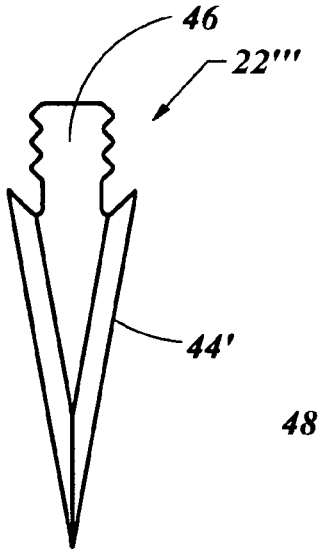
FIG. 11 is a plan view of an edged tool in the form of an arrowhead.
Figure 12:
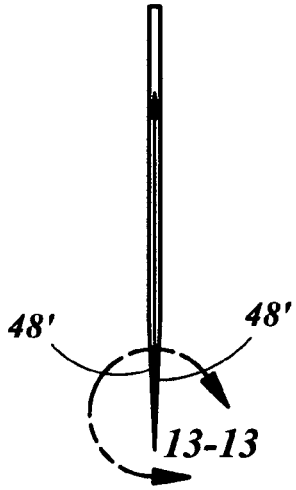
FIG. 12 is a side view of the edged tool of FIG. 11 showing the double bevel.
Figure 13:
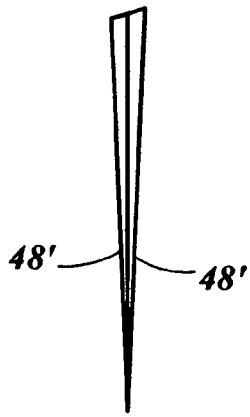
FIG. 13 is a detail view of the tip of the edged tool of FIG. 12 shown along line 13-13.

A similar process may be used to make a double bevel 48' in the blade portion 44' of the edged tool 22''' of FIGS. 11 through 13. In this embodiment a beveled edge 48' is produced on each side of the blade portion 44' of the edged tool 22'''. It may be desirable to have the cutting edge as provided by a beveled edge 48' on each side of the edged tool 22''' as the more centered the flow of air is around a projectile, the greater the tendency the projectile has to fly straight. As previously noted, when the edged tools 22 are contained within the frame of the base tool 20, the structure of the base tool 20 acts as a sheath with regard to the edged tools 22. Therefore, many edged tools 22 may be housed together and transported safely without fear of causing injury to the user. When needed, one or more edged tools 22 may be removed from the base tool 20, while any remaining edged tools 22 may remain housed by the structure of the base tool 20.

Figure 14:
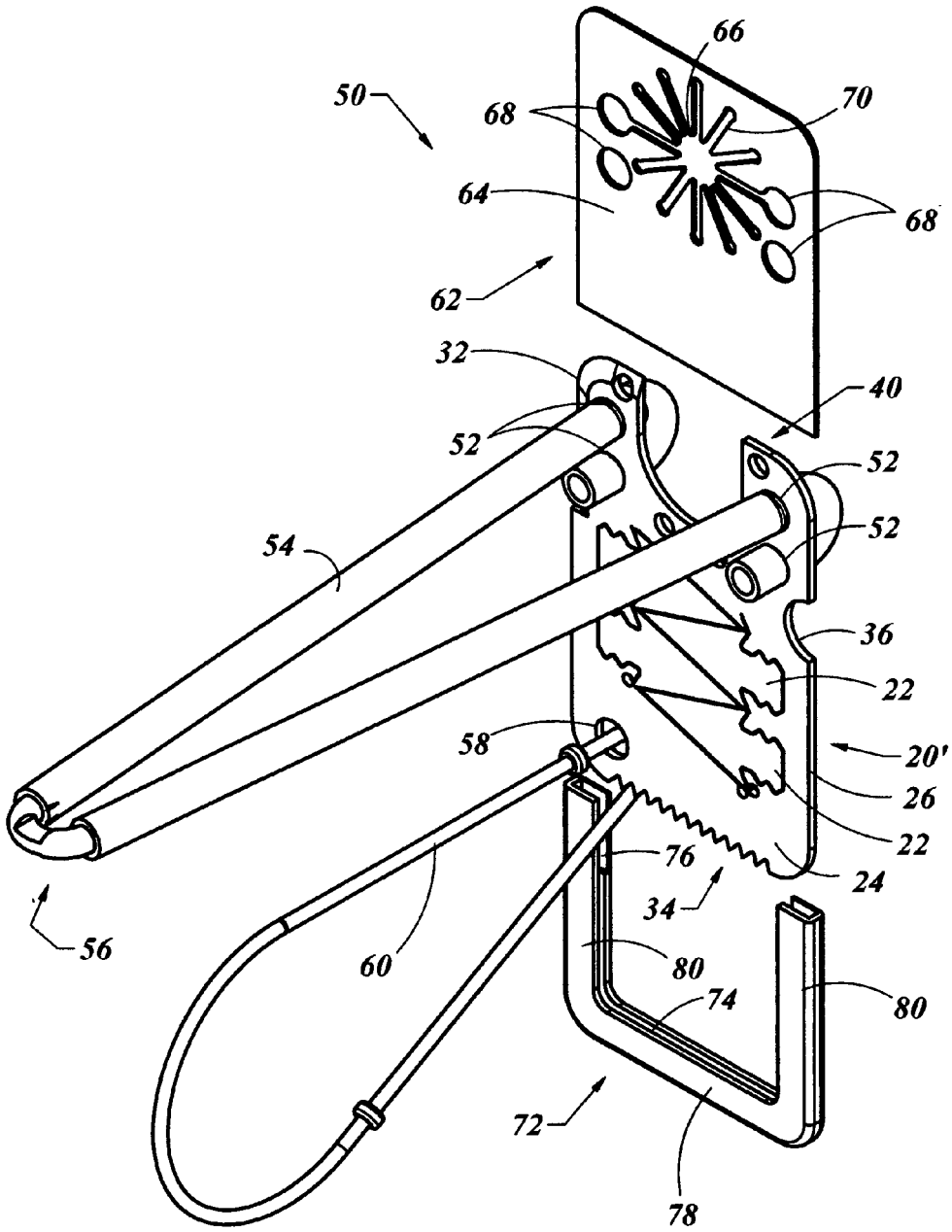
FIG. 14 is an isometric view of a partially disassembled survival tool system.

With reference to FIG. 14, a partially disassembled assembly of a survival tool system 50 is shown. In this embodiment, the tool base 20', includes one or more edged tools 22. The tool base 20' includes a bow rail 40, as previously disclosed in FIG. 5. Two or more receiver holes 52 may be provided on either side of the base tool 20' and adapted to receive an elastic element 54, thereby releasably securing the elastic element 54 to the tool base 20'. The elastic element 54 may take many forms. What is required of the elastic element 54 is that it be substantially longitudinal and enable storage of elastic energy. A strip of surgical tubing may be used, with a mid section 56 reduced in size to be received by the end of an arrow or other projectile. Though two receiver holes 52 are shown here on each side of the bow rail 40, another embodiment includes a single receiver hole 52 on each side of the bow rail 40. The elastic member 54 may be knotted or otherwise secured to prevent it from dislodging from the base tool 20' when tension is applied to the elastic member 54.

The substantially flat face 24 of the base tool 20' may also include a hole 58 to receive a tether 60. The tether 60 may be adapted to be used in the secure transport of the survival tool system 50. When firing a projectile from the survival tool system 50, a good deal of tension may be provided to the elastic element 54. The user may grasp the base tool 20' to apply the reaction force necessary to steady the system 50. The tether may be received by the user's wrist and secured to provide added support during the aiming process. As well, the tether secured to the wrist of the user may reduce the risk of injury if the base tool 20' became dislodged from the user's hand while tension was being applied to the elastic member 54, pulling the base tool 20' toward the face of the user. The tether 60 secured to the wrist of the user may act to limit the accidental movement of the base tool 20' and thereby avoid contact with the head of the user.

A ledgecard 62 may be provided to assist in the firing process of a projectile from the survival tool system 50. The ledgecard 62 may be comprised of a substantially flat card 64 with a central hole 66 and two or more radially positioned holes 68. A plurality of slots 70 may extend from the central hole 66 and may be continuous with one or more of the radial positioned holes 68. The ledgecard 62 may be positioned adjacent to the base tool 20' with the radially positioned holes 68 aligned with the receiver holes 52 of the base tool 20'. The elastic element 54 may be used to releasably secure the ledgecard 62 to the base tool 20'.

A sheath 72 may be provided and received by at least one outer edge 26 of the base tool 20'. In this embodiment the sheath 72 includes a first cavity 74 to receive the bottom portion of the base tool 20' as well as a second cavity 76 to receive the bottom portion of the ledgecard 62, further aiding in the secure support of the ledgecard 62 to the base tool 20'. In this embodiment the sheath 72 includes a base 78 and two substantially parallel walls 80, both the base 78 and the walls 80 receiving an outer edge 26 of the base tool 20'. The height of the walls 80 may be a portion of the dimension of the base tool 20', as shown here, or they may be the full length of the base tool 20'. If the walls 80 are shorter than the base tool 20', the sheath 72 may be used to make a more comfortable fit in the hand of the user while some of the secondary tools such as the knife blade 32 or the arrow scraper 36 are being used. The sheath 72 may be inverted and reattached to the base tool 20' if the saw blade 34 is to be used. Two sheathes 72 may be used to cover the base tool 20' completely on all sides if so desired.

Figure 15:
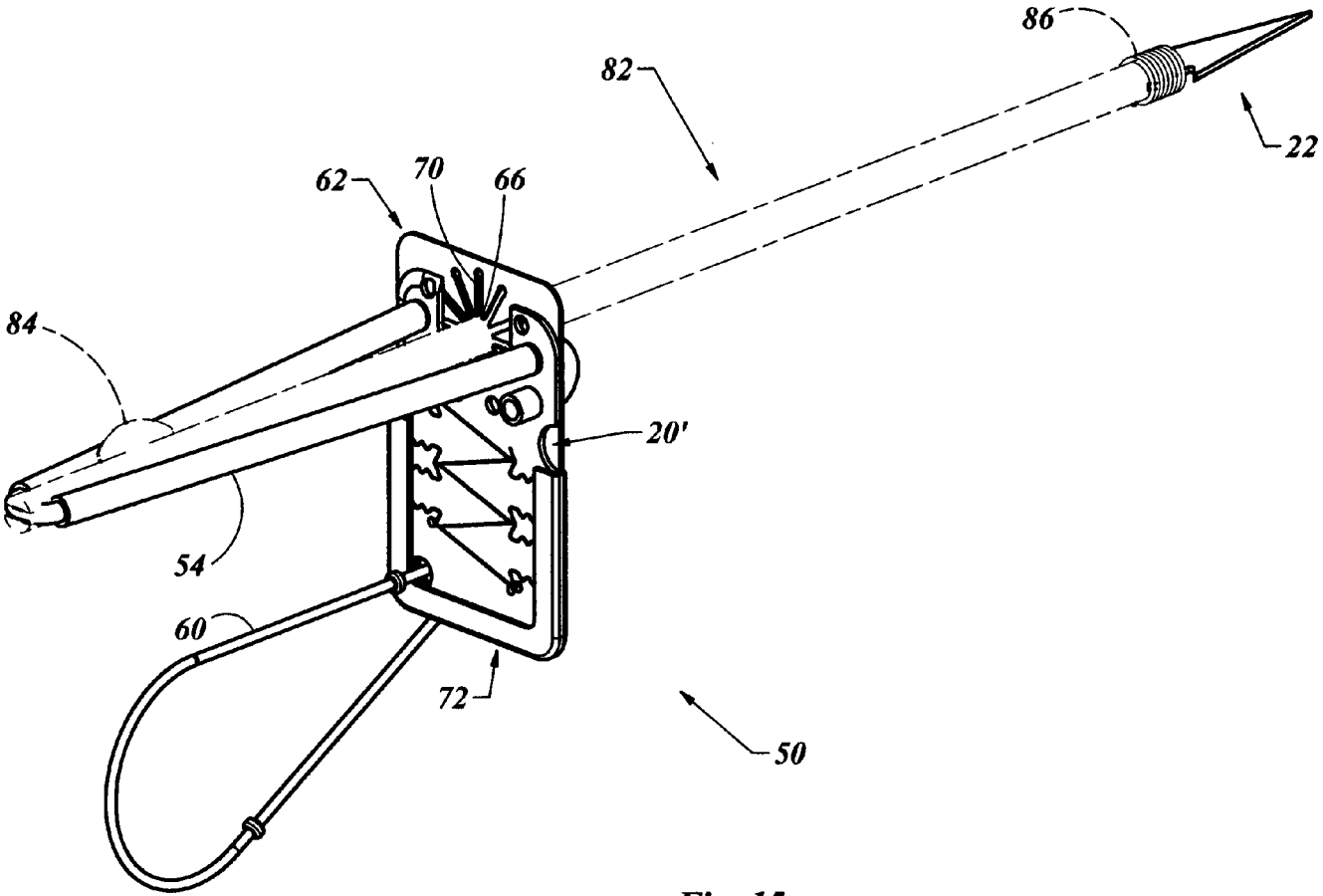
FIG. 15 is an isometric view of a survival tool system with a ledgecard supporting an arrow engaged with the elastic member.

The survival tool system 50, as previously disclosed in shown in FIG. 15, may be used with an arrow 82 as a projectile. The ledgecard 62 provides a guided support for the arrow body as it passes through the central hole 66. The slots 70 allow passage of the vanes 84 (or fletching) of the arrow 82 when the arrow 82 is fired. An edged tool 22 in the form of an arrowhead, may be fastened to the forward end of the arrow 82 after being removed from any one of the base tools 20. A cord 86 or any other means for fastening, may be used to secure the edged tool 22 to the end of the arrow 82.

Figure 17:
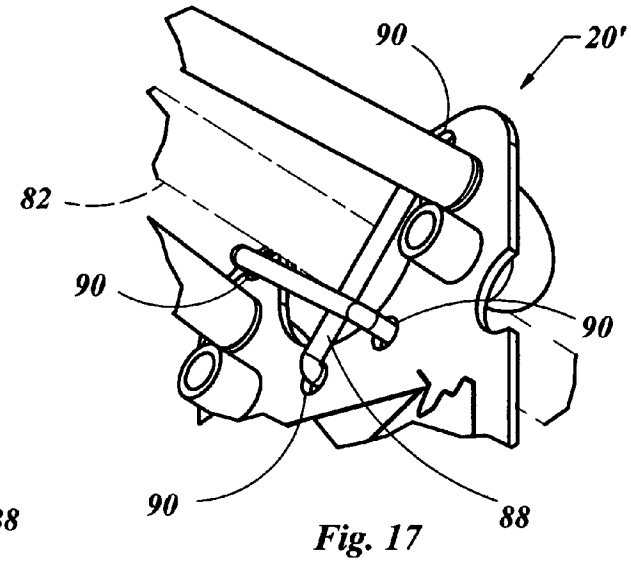
FIG. 17 is a detail view of the system of FIG. 16 along line 17-17, showing the cross cord attached to the base.
Figure 16:
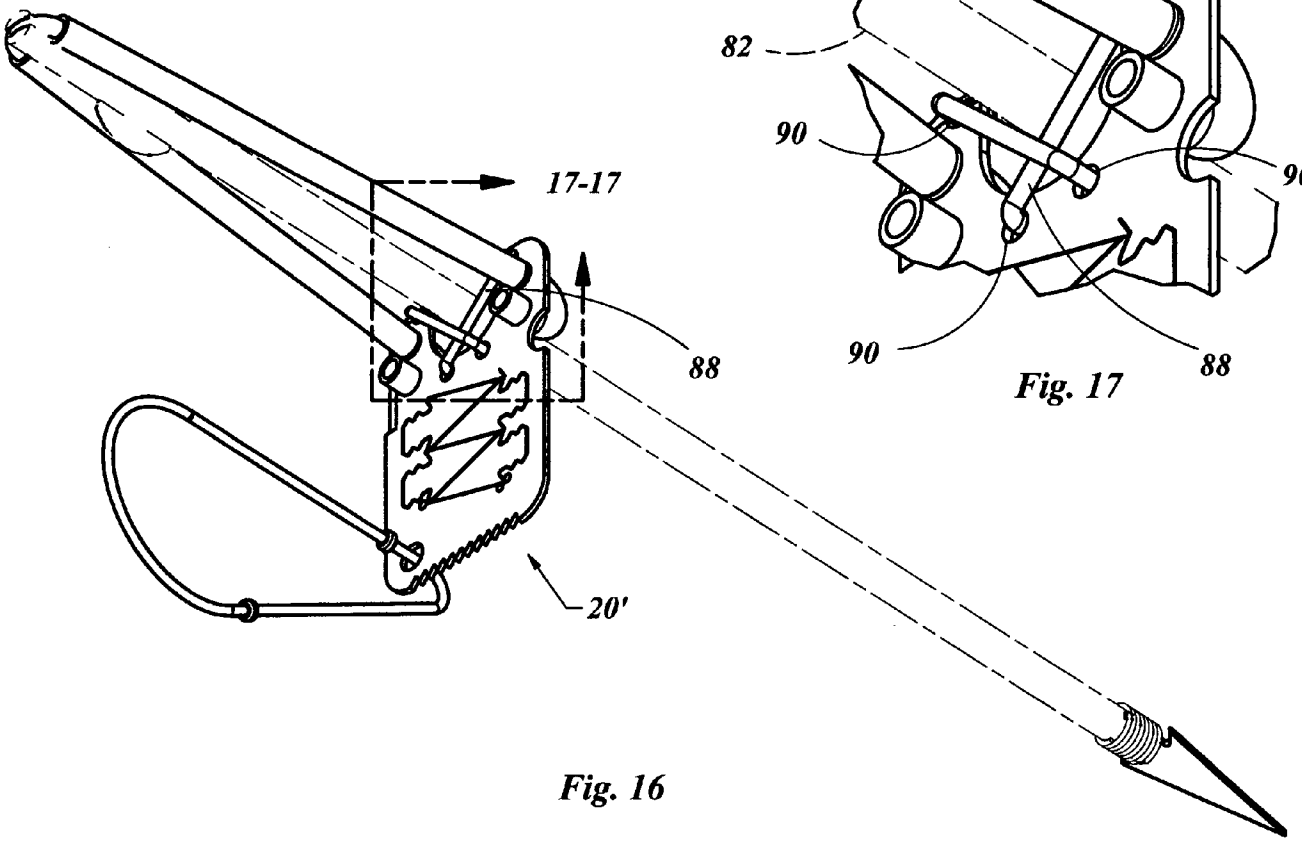
FIG. 16 is an isometric view of a survival tool system with a cross cord supporting an arrow engaged with the elastic member.

An alternate embodiment used to guide the arrow 82 is shown in FIGS. 16 and 17. A cross cord 88 may be connected through cord holes 90 in the base tool 20'. The cross cord 88 may form an "X" with the top "V" providing a nested support for the shaft of the arrow 82. In this embodiment, the cross cord 88 may be substituted for the ledgecard 62 as previously disclosed, in that the general function may be similar. An advantage to the cross cord 88 is it may be manufactured from a piece of cord or string and fastened to the base tool 20'. If it breaks during use, it may be replaced more easily than the ledgecard 62. In using the ledgecard 62 or the cross cord 88, the function is to assist the arrow 82 or other projectile in a more true flight, but may not be a requirement to the function of any survival tool system 50 as shown and described.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. A survival system, comprising:

a substantially rigid base with an outer edge and a substantially flat face; and a relief defining an edged tool in the shape of an arrowhead in the substantially flat face, whereby applying pressure to the edged tool will cause the tool to separate from the substantially rigid base.

2. The survival system according to claim 1, wherein the substantially rigid base includes a secondary tool incorporated into the outer edge.

3. The survival system according to claim 2, wherein the secondary tool is comprised of a knife blade including a beveled edge.

4. The survival system according to claim 2, wherein the secondary tool is comprised of a saw blade.

5. The survival system according to claim 2, wherein the secondary tool is comprised of an arrow scraper including an arcuate scraping edge adapted to receive an arrow shaft.

6. The survival system according to claim 2, wherein the secondary tool is comprised of a flat scraper with a substantially flat edge.

7. The survival system according to claim 2, wherein the secondary tool is comprised of a bow rail including a U-shaped opening.

8. The survival system according to claim 1, wherein the substantially rigid base is in the general shape of a parallelogram.

9. The survival system according to claim 8, wherein the parallelogram has one side with a dimension between 3.30 and 3.55 inches and a second dimension between 2.0 and 2.25 inches.

10. The survival system according to claim 1, wherein the substantially flat face includes a hole and a tether received by the hole, whereby the tether is adapted to be used in the secure transport of the survival system.

11. The survival system according to claim 1, further comprising a sheath received by at least one outer edge of the substantially rigid base.

12. The survival system according to claim 1, wherein the edged tool includes a blade portion and a shank portion.

13. The survival system according to claim 12, wherein the blade portion includes a beveled edge.

14. The survival system according to claim 1, wherein the relief defines more than one edged tool in the substantially flat face.

15. The survival system according to claim 1, further comprising an elastic element fastened to the substantially rigid base, the elastic element adapted to receive a projectile.

16. The survival system according to claim 15, further comprising a projectile support to aid in support of the projectile while in contact with the elastic element.

17. The survival system according to claim 16, wherein the projectile support is a ledgecard.

18. The survival system according to claim 16, wherein the projectile support is a cross cord fastened to the substantially rigid face.

19. A survival system, comprising:

a base means including an outer edge and a face; and a relief in the face defining an edged tool including a blade portion and a shank portion, whereby the edged tool is displaced from the base means by applying force to the edged tool relative to the base means.

20. The survival system according to claim 19, wherein the edged tool has the shape of an arrowhead.

21. The survival system according to claim 19, further comprising a secondary tool consistent with the outer edge.

22. The survival system according to claim 21, wherein the secondary tool is a tool selected form the group consisting of a saw blade, a knife blade, an arrow scraper, a scraper edge and a bow rail.

23. A method of producing a defense weapon for use with a survival system of the type including a substantially rigid base with an outer edge and a substantially flat face; and a relief defining an edged tool in the substantially flat face, the method of producing a weapon including the steps of:

applying pressure to the edged tool;

separating the tool from the substantially rigid base; and fastening the tool to one end of an elongate stick.

* * * * *